US012084226B2

(12) United States Patent
Rohrer

(10) Patent No.: US 12,084,226 B2
(45) Date of Patent: Sep. 10, 2024

(54) RACKABLE RECEPTACLE FOR LIQUID DISPENSING CONTAINER

(71) Applicant: Rarr, LLC, Portland, OR (US)

(72) Inventor: Chris Rohrer, Portland, OR (US)

(73) Assignee: Christopher Rohrer, Portland, OR (US)

( * ) Notice: Subject to any disclaimer, the term of this patent is extended or adjusted under 35 U.S.C. 154(b) by 10 days.

(21) Appl. No.: 17/403,628

(22) Filed: Aug. 16, 2021

(65) Prior Publication Data

US 2022/0081165 A1 Mar. 17, 2022

Related U.S. Application Data

(60) Provisional application No. 63/079,688, filed on Sep. 17, 2020.

(51) Int. Cl.
*B65D 23/00* (2006.01)
*A63B 21/078* (2006.01)
*B65D 25/22* (2006.01)

(52) U.S. Cl.
CPC ..... *B65D 23/003* (2013.01); *A63B 21/0783* (2015.10); *B65D 25/22* (2013.01); *A63B 2225/68* (2013.01)

(58) Field of Classification Search
CPC .. B65D 23/003; B65D 25/22; A63B 21/0783; A63B 2225/68
See application file for complete search history.

(56) References Cited

U.S. PATENT DOCUMENTS 5,157,843 A * 10/1992 Barcewski ..... G01C 15/10 33/666
5,499,742 A * 3/1996 Ives, Sr. ..... B65D 35/34 222/105
5,595,324 A * 1/1997 Brown ..... A47K 5/1202 261/DIG. 65
5,791,525 A * 8/1998 Fan ..... A47K 5/1204 222/325
5,799,826 A * 9/1998 Brown ..... A61L 9/122 261/DIG. 65
6,036,056 A * 3/2000 Lee ..... A47K 5/1209 222/105
6,131,773 A * 10/2000 Wade ..... A47K 5/1215 222/153.09
6,755,325 B2 * 6/2004 Haase ..... A47K 5/122 222/326

(Continued)

*Primary Examiner* — Frederick C Nicolas
(74) *Attorney, Agent, or Firm* — Ganz Law, PC

(57) ABSTRACT

A rackable receptacle dispenser system has a racking body and a wrap coupled to the racking body. The racking body has a rear wall having a front face and a rear face, a bottom wall extending orthogonally in a front direction from the front face. The racking body is detachably coupable to a rack support. The bottom wall defines an aperture. The wrap includes a wall that extends orthogonally upward from the bottom wall, and that defines an interior compartment. The system includes a container that includes a body and a dispensing aperture. The container is configured to hold a liquid and to dispense the liquid through the dispensing aperture. The system is configured to hold the container in the interior compartment with the dispensing aperture extending through the aperture defined in the bottom wall.

15 Claims, 15 Drawing Sheets

(56) References Cited

U.S. PATENT DOCUMENTS

| | | | | |
|---|---|---|---|---|
| 6,789,701 | B1 * | 9/2004 | Smith | A47K 5/18 222/464.2 |
| 7,527,171 | B2 * | 5/2009 | Ophardt | A47K 5/1207 222/86 |
| 7,708,167 | B2 * | 5/2010 | Krengel | A47K 10/3827 239/289 |
| 7,857,170 | B2 * | 12/2010 | Ophardt | A47K 5/12 222/181.3 |
| 8,245,881 | B2 * | 8/2012 | Ophardt | B67D 1/0004 222/336 |
| 8,365,954 | B2 * | 2/2013 | Ophardt | B65D 1/0292 220/666 |
| 8,733,597 | B2 * | 5/2014 | Fitzpatrick | A47K 5/1209 417/412 |
| 8,777,064 | B2 * | 7/2014 | Williams | A61L 2/18 16/412 |
| 8,827,120 | B2 * | 9/2014 | Boshuizen | A47K 5/1207 222/282 |
| 8,936,179 | B2 * | 1/2015 | Hsu | A47K 5/14 222/190 |
| 9,682,390 | B2 * | 6/2017 | Ophardt | A47K 5/12 |
| 10,518,930 | B2 * | 12/2019 | May | B65D 35/36 |
| 11,247,837 | B1 * | 2/2022 | May | A61J 1/067 |

* cited by examiner

RACKABLE RECEPTACLE FOR LIQUID DISPENSING CONTAINER

RELATED APPLICATION

This application claims the benefit of and priority to U.S. Provisional Patent Application No. 63/079,688, filed on Sep. 17, 2020, which is hereby incorporated by reference in its entirety for all purposes.

FIELD

The inventive subject matter disclosed in and contemplated by this application (referred to as the "disclosure") generally concerns receptacles that can be attached to a weight training rack or similar structure, for holding a dispensing container of liquid.

BACKGROUND INFORMATION

People who use weight training and gymnastic equipment such as barbells, pull-up bars, rings, and other devices gripped by the hands may use chalk to improve their grip on the equipment. Chalk is available in a dry powdered form and as liquid chalk. Liquid chalk is provided in bottles from which the liquid chalk can be poured, squeezed, or otherwise dispensed.

Gym facilities generally lack convenient storage areas for loose items such as bottles. A loose bottle may be moved by a user away from one rig to another, causing another user at the original rig to have to search for the bottle. A loose bottle placed on the floor may be knocked over and roll away, making it inaccessible or a possible safety hazard. Further, many athletes perform timed workouts. If a bottle is needed but not in place and accessible where it is needed, an athlete may use time to search for the bottle, disrupting the efficiency of the workout.

Accordingly, there is a need for improved ways to keep containers of liquid chalk, or other liquids, off of the floor and convenient to a location where the liquid is used.

SUMMARY

This disclosure addresses the foregoing and other needs in various embodiments.

Generally, a receptacle that can hold a container of a liquid, such as liquid chalk, is attached to a racking body that permits the receptable to be mounted, or "racked", onto a weight training rack. The receptacle may hold the container in such a way that the container can remain in the receptacle while the liquid is being dispensed from the container.

Thus, the rackable receptacle products disclosed herein overcome many problems in the prior art and address one or more of the aforementioned or other needs.

In one possible embodiment, the inventive subject matter is directed to a rackable receptacle that has a racking body and a wrap coupled to the racking body. The racking body has a rear wall having a front face and a rear face, a bottom wall extending orthogonally in a front direction from the front face, and means for detachably coupling the racking body to a rack support. The bottom wall may define an aperture. The wrap comprises a wall that extends orthogonally upward from the bottom wall, and that defines an interior compartment. The rackable receptacle is configured to hold a container of liquid in the interior compartment with a dispensing aperture of the container extending through the aperture defined in the bottom wall.

The foregoing and other features and advantages will become more apparent from the following detailed description, which proceeds with reference to the accompanying drawings.

BRIEF DESCRIPTION OF THE DRAWINGS

Referring to the drawings, wherein like numerals refer to like parts throughout the several views and this specification, aspects of presently disclosed principles are illustrated by way of example, and not by way of limitation.

DETAILED DESCRIPTION

The following describes various principles related to receptacles that hold containers for liquids, where the receptacles can be detachably coupled to a weight training rack or rig, i.e., "racked". As but one illustrative example, a rackable receptacle can have a racking body that connects and disconnects from an upright support on a weight training rack, and a wrap connected to the racking body that holds a container, e.g., for liquid chalk, a cleaning solution, or hand sanitizer. That said, descriptions herein of specific product configurations, and specific combinations of method acts, are but particular examples of contemplated products and methods chosen as being convenient illustrative examples of disclosed principles. One or more of the disclosed principles can be incorporated in various other products and methods to achieve any of a variety of corresponding, desired characteristics. Thus, a person of ordinary skill in the art, following a review of this disclosure, will appreciate that products and methods having attributes that are different from those specific examples discussed herein can embody one or more presently disclosed principles, and can be used in applications not described herein in detail. Such alternative embodiments also fall within the scope of this disclosure.

Weight training racks, rigs, stands, and other support structures, referred to herein as "racks", provide support for a barbell off of the ground for use in exercises such as, for example, squats and presses. Racks usually include two or more upright supports that are anchored to the floor, the wall, and/or ceiling of a gym building. Some racks are free-standing and are stabilized by connecting the upright supports to each other with one or more cross-members and to feet that prevent the rack from tipping over under normal use.

An upright support is usually a metal or wooden post with a square or rectangular cross-section. That is, the upright support usually has four sides, where opposing sides are parallel to each other and adjacent sides are orthogonal to each other. Holes are positioned along at least one pair of parallel sides. Upright supports may be hollow, where each hole on one side is aligned with a hole on the parallel side. Upright supports that are solid may have holes formed from one side through to the opposing parallel side. Support brackets, e.g., J-cups, can be positioned and secured on the upright supports using the holes, where they can be used to support a barbell.

Examples of a rackable receptacle product and methods of use with a weight rack and a container of liquid will be described in the context of the accompanying figures.

Figure 1:
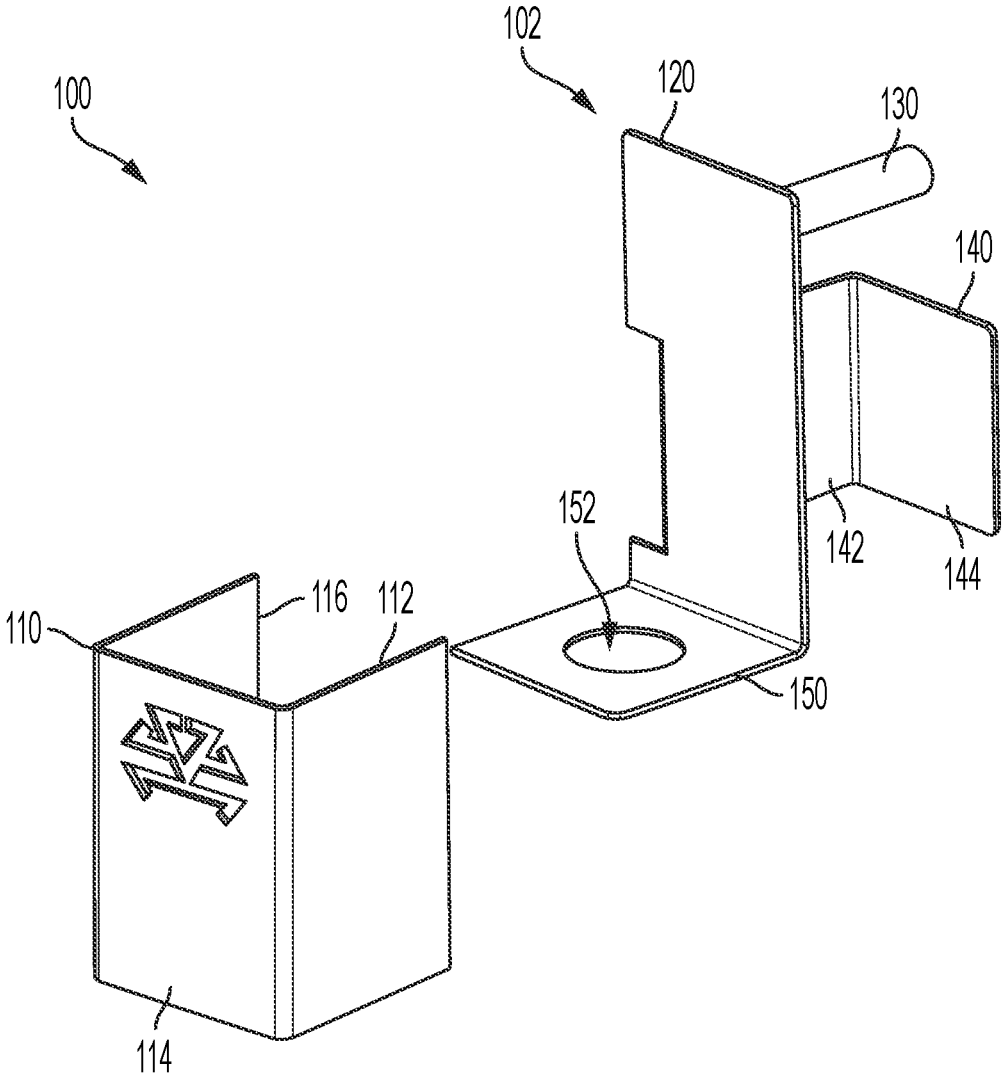
FIG. 1 shows an exploded view of a rackable receptacle for a liquid container.

FIGS. 1-7 show an example of a rackable receptacle 100 for holding a container. FIG. 1 shows an exploded view of the rackable receptacle 100. The rackable receptacle 100 may include a racking body 102 and a wrap 110. The racking body 102 may include a rear wall 120, a pin 130, a stabilizer 140, and a bottom wall 150.

The rear wall 120 may be planar and generally rectangular. The pin 130 may extend orthogonally from the rear wall 120 in a rearward direction. The pin 130 may be sized to fit through the holes provided in the upright support of a rack. For example, the pin 130 may be cylindrical, with a diameter that is slightly smaller than the diameter of the rack holes, and may have a length $l_p$ that is slightly longer than the width of one side of the upright support.

The stabilizer 140 may include a side panel 142 and a rear panel 144. The side panel 142 may be planar and may extend orthogonally from the rear wall 120 with the plane oriented vertically. The side panel 142 may have a length $l_s$ that is slightly longer than the width of one side of the upright support of the rack. The rear panel 144 may be planar and may extend orthogonally from the side panel 142 with the plane oriented vertically and substantially parallel with the rear wall 120. The space defined between the rear wall 120 and the rear panel 144 may be configured to fit around an upright support of a rack. The rear panel 144 and the side panel 142 may have the same length, or may have different lengths.

The bottom wall 150 may be planar and may extend orthogonally from the rear wall 120 in a forward direction, with the plane oriented horizontally, and perpendicular to the side panel 142 and the rear panel 142. The bottom wall 150 may define an aperture 152.

The wrap 110 may include one or more walls, e.g., a right wall 112, a front wall 114, and a left wall 116. The walls may be planar and may be rectangular. The right wall 112 may be connected on a front side to the right side of the front wall 114 and on an opposing rear side to the rear wall 120. The left wall 116 may be connected on a front side to the left side of the front wall 114 and on an opposing rear side to the rear wall 120. The respective side walls and front wall may be connected to each other at a right angle, or may be connected at a non-right angle. The bottom edges of the right wall 112, the front wall 114, and the left wall 116 may each be connected to the bottom wall 150, for example, at or near the perimeter of the bottom wall 150. When connected to the bottom wall 150 and the rear wall 120, the walls of the wrap 110 may extend orthogonally upward from the bottom wall 150. The front wall 114 may be parallel to the rear wall 120. When so connected, the wrap 110 may define an interior compartment configured to hold a container, e.g., a liquid chalk bottle, a hand sanitizer bottle, a cleaning solution bottle, or a water bottle. A dispensing end of the container can extend through the aperture 152.

Although depicted as having a three-sided wall, other configurations for the wrap 110 may be used. The wrap may comprise a cylindrical wall, or may comprise two walls that define a triangular space, with the rear wall, for the liquid container. The wrap may comprise four or more walls to define a space of various other polyhedral shapes, such as, for example, a pentagon, a hexagon, or an octagon. In such configurations, the bottom wall 150 may have a perimeter shape that matches the configuration of the wall, or may remain rectangular as shown.

The rackable receptable 100 may be made from any of a variety of rigid materials. For example, the rackable receptable 100 may be made of metal, such as steel, aluminum, or metal alloys, and may be molded or cut and affixed together. The rackable receptable 100 may be made from a rigid plastic that may be molded or 3-D printed. The material or materials selected may generally be rigid enough to resist bending or otherwise deforming under the weight of a container placed in the receptacle and to remain in place when racked onto a weight training rack.

Figure 2:
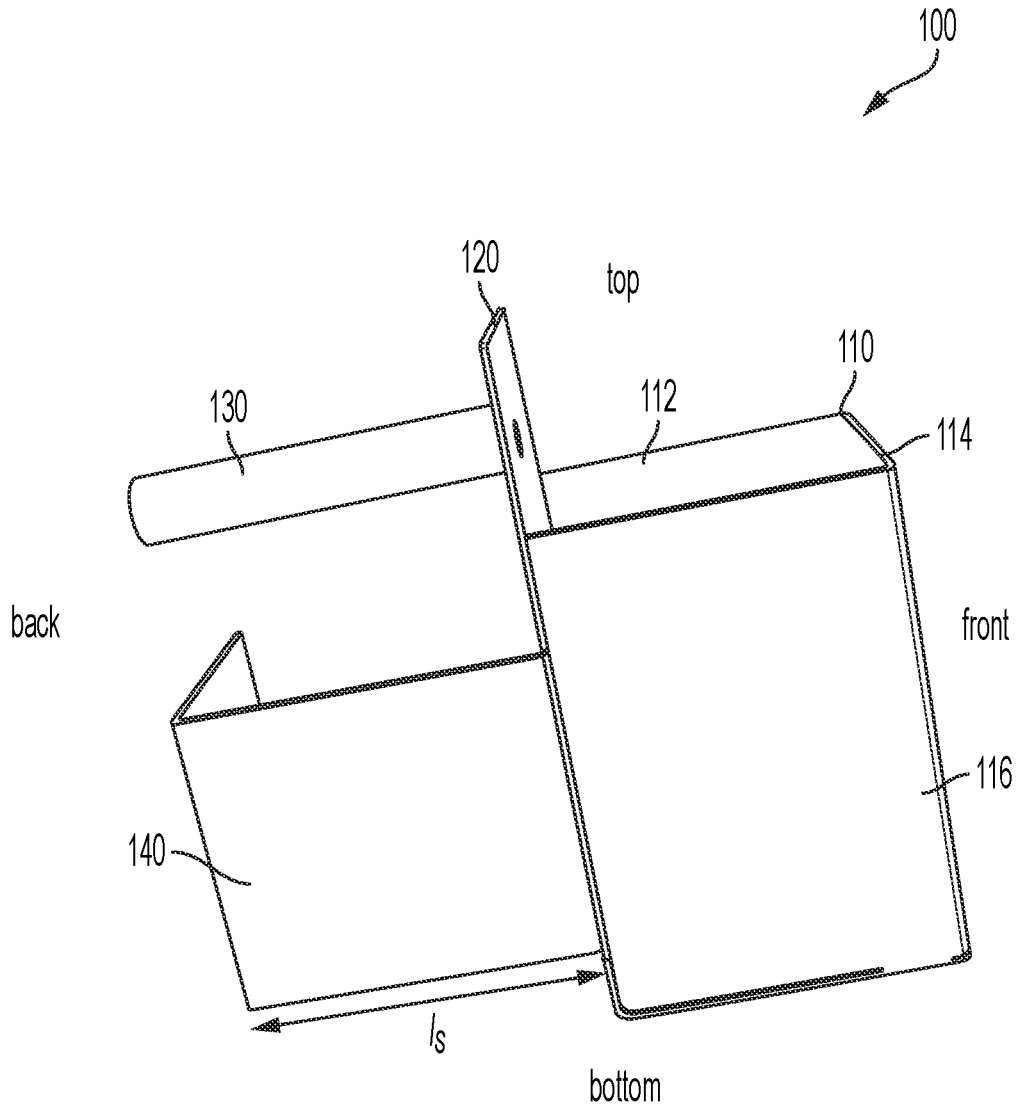
FIG. 2 shows a view of the left side of the rackable receptacle.
Figure 3:
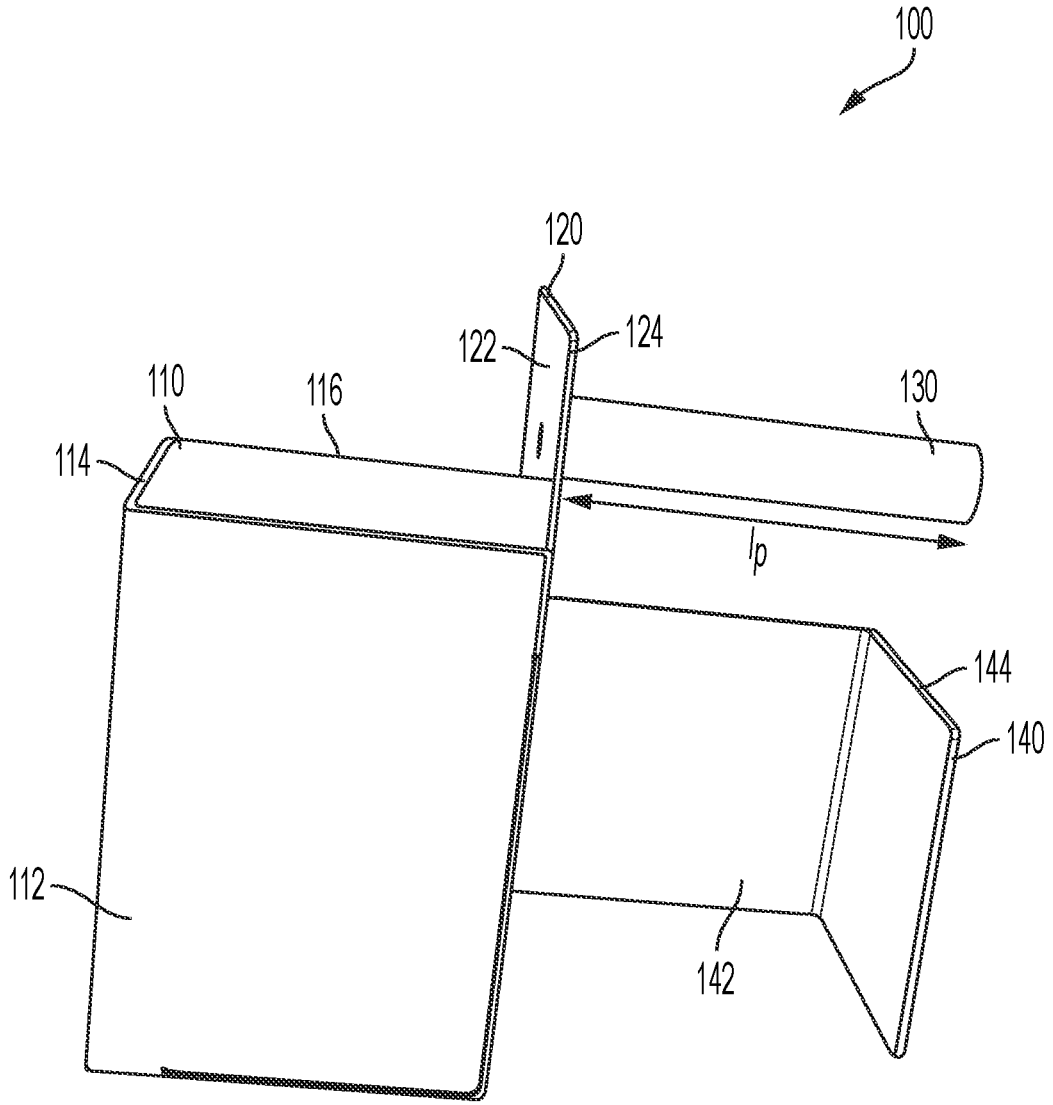
FIG. 3 shows a view of the right side of the rackable receptacle.

For the purposes of discussion, the front of the rackable receptacle 100 is the outward face of the front wall 114, the back (or rear) of the rackable receptable 100 is at the end of the pin 130 and the outward face of the rear panel 144. "Left" and "right" refer to the left and right sides as the rackable receptacle 100 is viewed from the front. FIG. 2 shows a view of the left side of the rackable receptacle 100 with the wrap 110 connected to the racking body 120. FIG. 3 shows a view of the right side of the rackable receptacle with the wrap 110 connected to the racking body 120. As seen in FIG. 3, the rear wall 120 has a front face 122 and a rear face 124. The free vertical edges of the wrap 110 may be connected to the front face 122. The pin 130 may be connected to the rear face 124.

Figure 4:
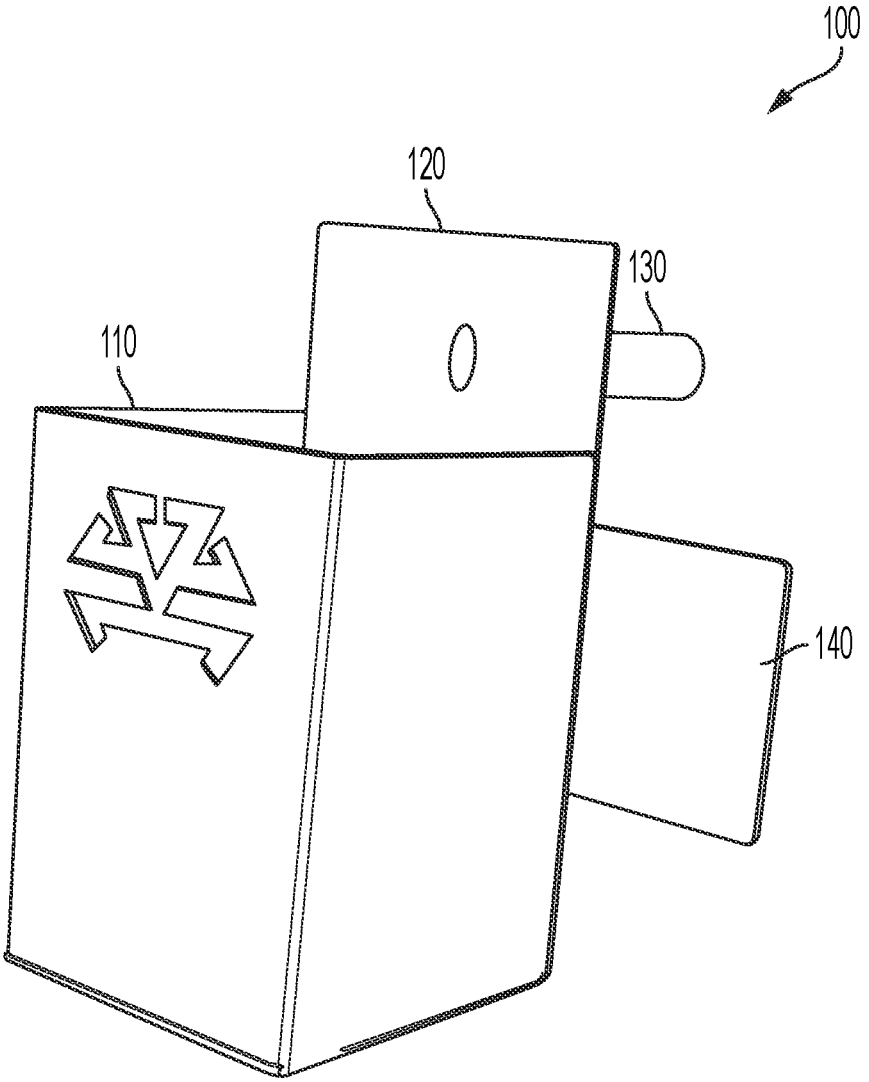
FIG. 4 shows a view of the right front side of the rackable receptacle.
Figure 5:
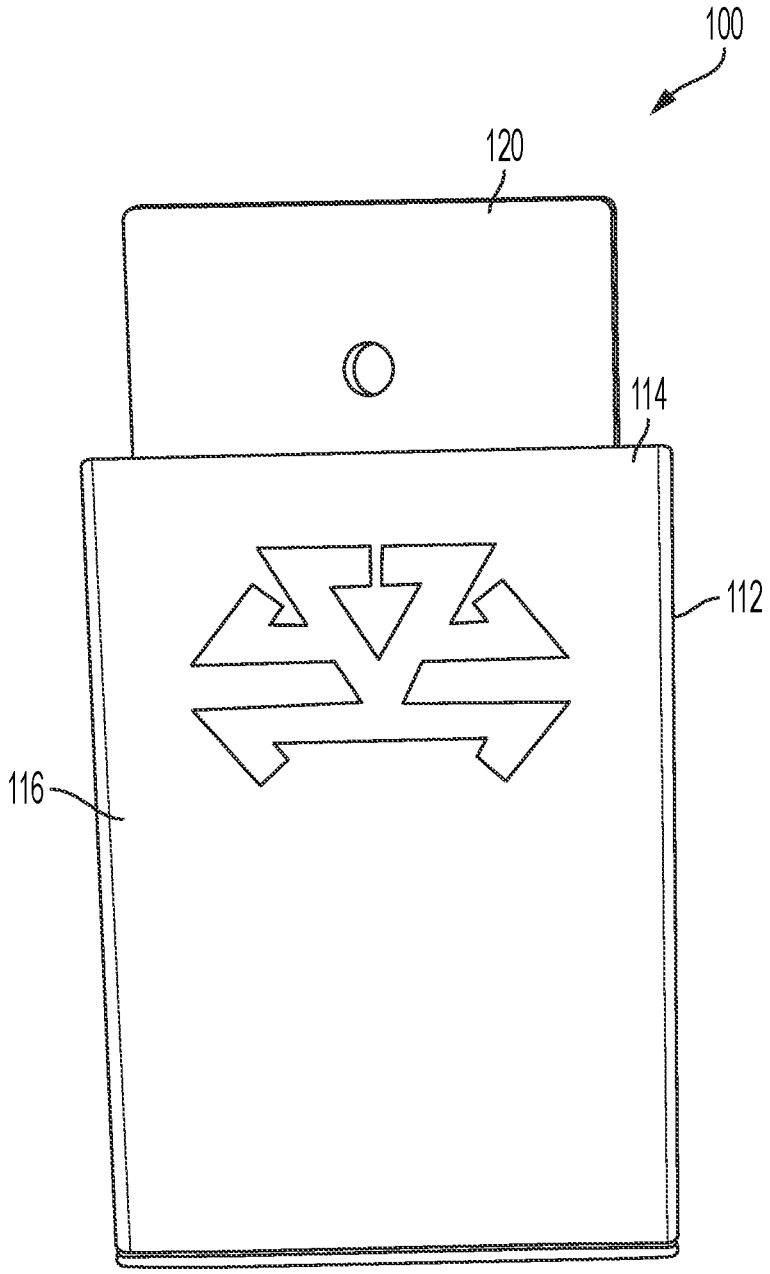
FIG. 5 shows a view of the front of the rackable receptacle.

FIG. 4 shows a view of the right front side of the rackable receptacle 100. FIG. 5 shows a view of the front of the rackable receptacle 100.

Figure 6:
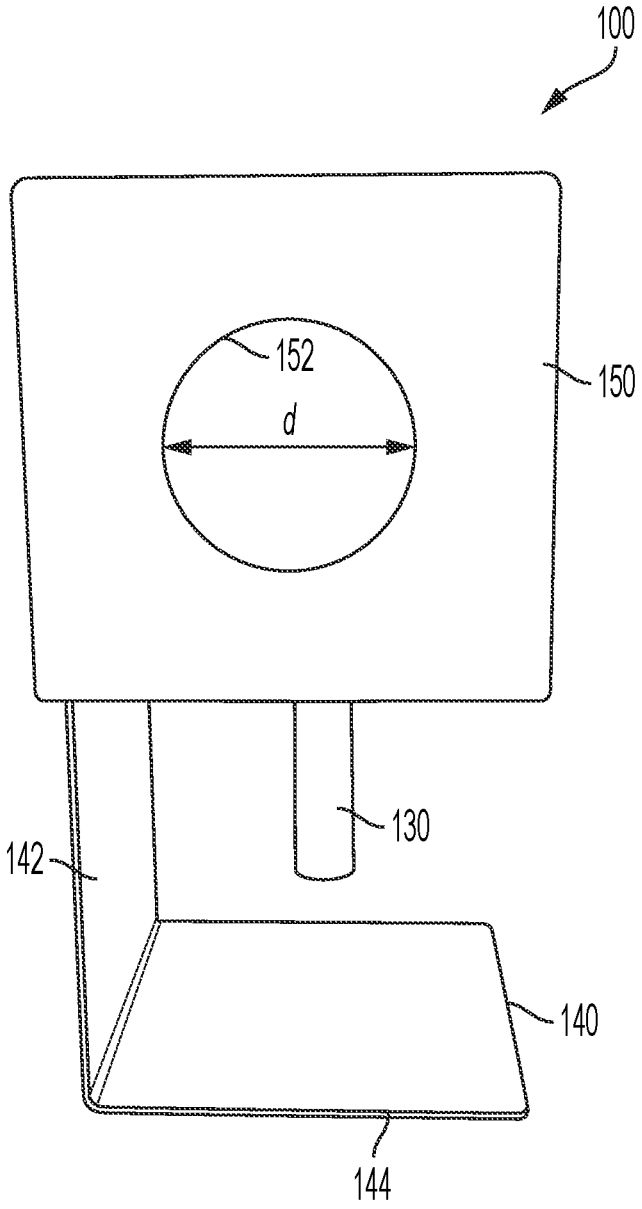
FIG. 6 shows a view of the bottom of the rackable receptacle.

FIG. 6 shows a view of the bottom of the rackable receptacle. As seen in FIG. 6, the aperture 152 has a diameter d. The diameter of the aperture 152 may be sufficient to permit a dispensing end of a container to extend through the aperture, without permitting the container itself to pass through the aperture. Although shown with a circular perimeter, the aperture 152 have perimeters of other shapes, such as, for example, triangular, hexagonal, elliptical, or rectangular.

Figure 7:
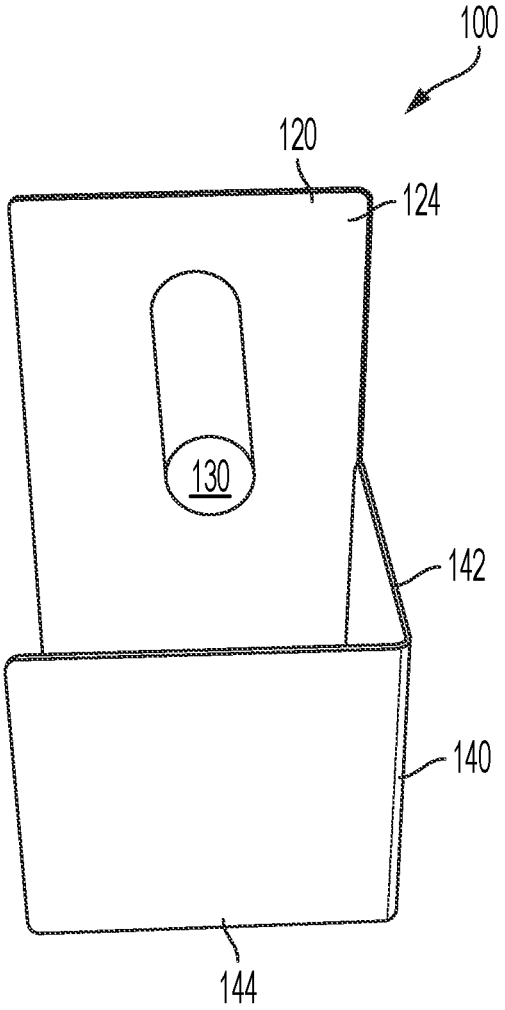
FIG. 7 shows a view of the back of the rackable receptacle.

FIG. 7 shows a view of the back of the rackable receptacle 100.

Figure 8:
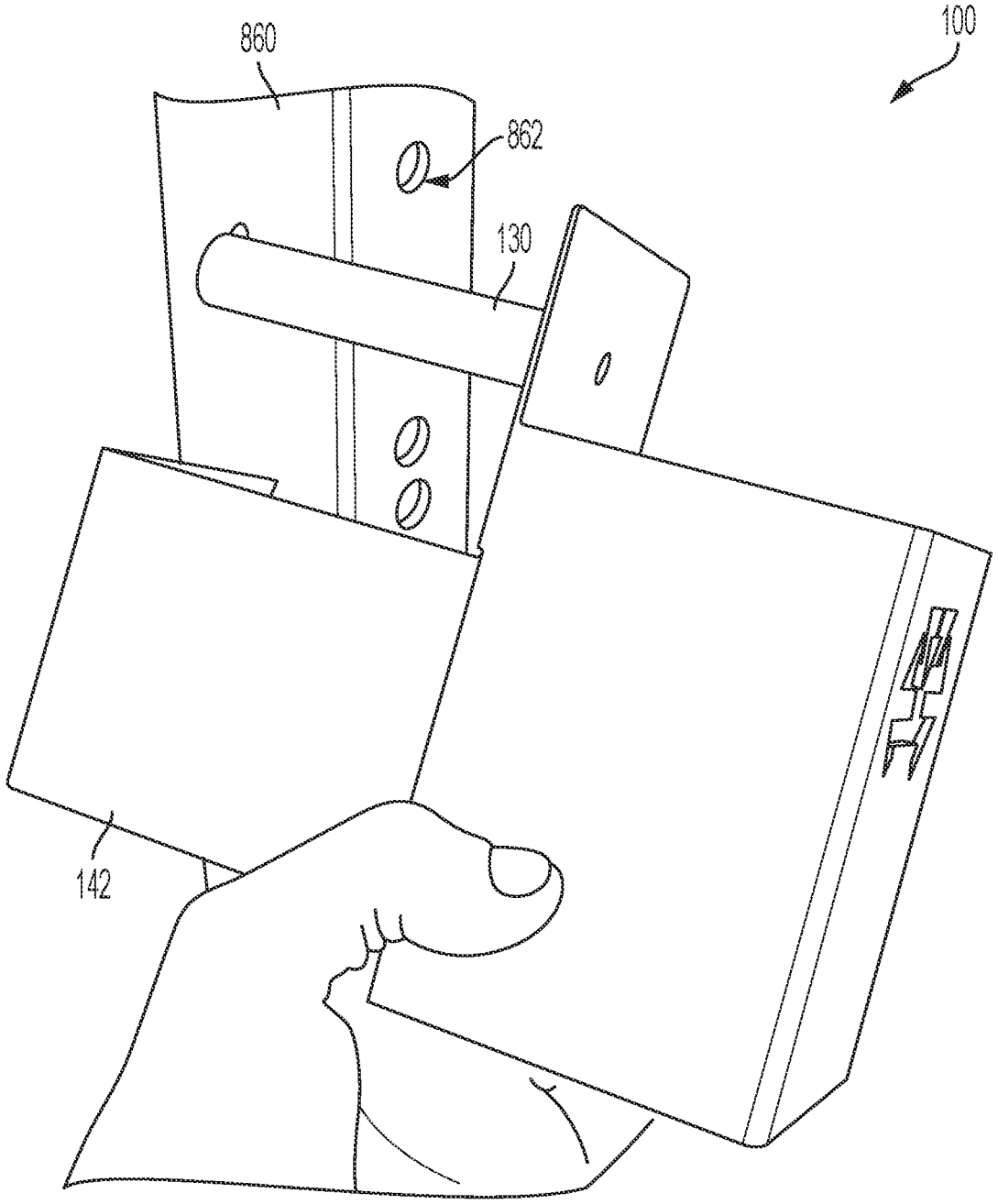
FIG. 8 shows the rackable receptacle de-coupled from a rack support.
Figure 9:
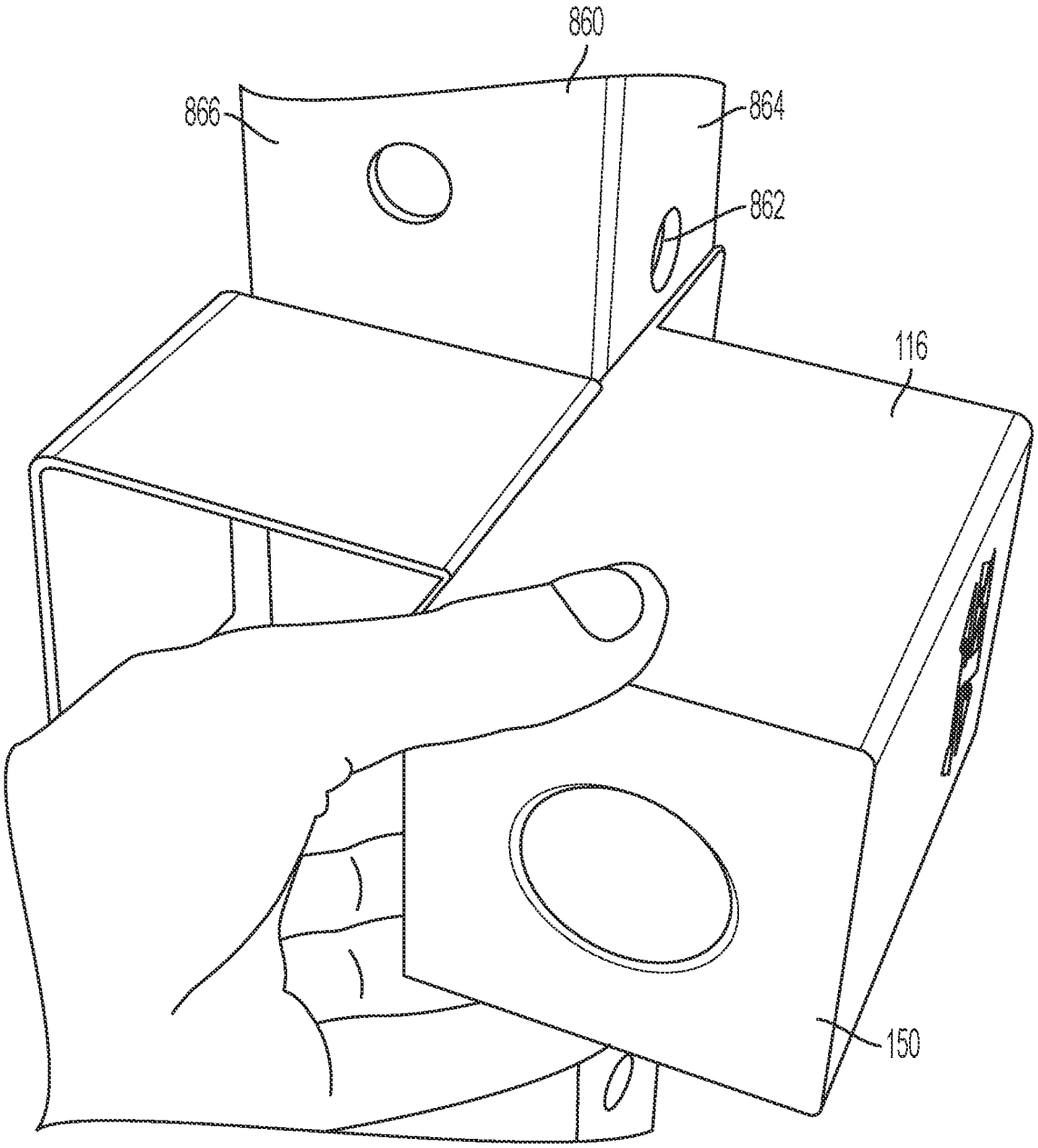
FIG. 9 shows the rackable receptable at a first step of coupling to the rack support.

FIG. 8 shows the rackable receptacle 100 prior to being racked on to a rack support 860. The rack support 860 has a plurality of holes, e.g., hole 862. In FIG. 9, the pin 130 has been inserted through a hole below the hole 862 on a face 864 of the rack support 860. The rear face 124 of the rear wall 120 is flush against the face 864. Accordingly, the pin and and rear wall are means for detachably coupling the rackable receptacle to the rack support.

Figure 10:
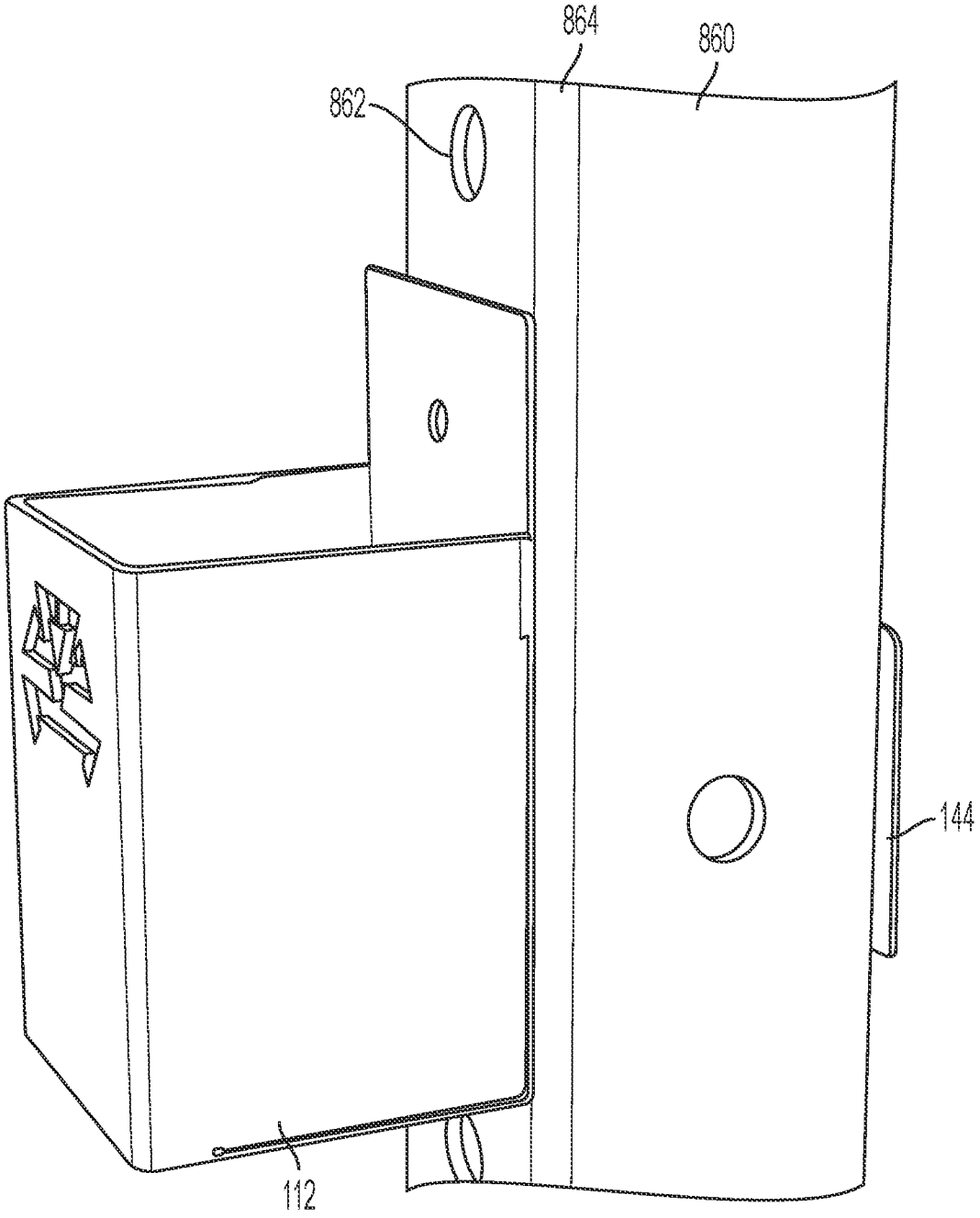
FIG. 10 shows a view of the right side of the rackable receptable coupled to the rack support.

FIG. 10 shows a view of the right side of the rackable receptable 100 coupled to the rack support 860 when the rackable receptable 100 has been rotated about the pin 130. In the racked position shown, the rack support 860 is positioned between the rear face 124 of the rear wall 120 and the front face of the rear panel 144. The rackable receptable 100 is now oriented in its upright position.

Figure 11:
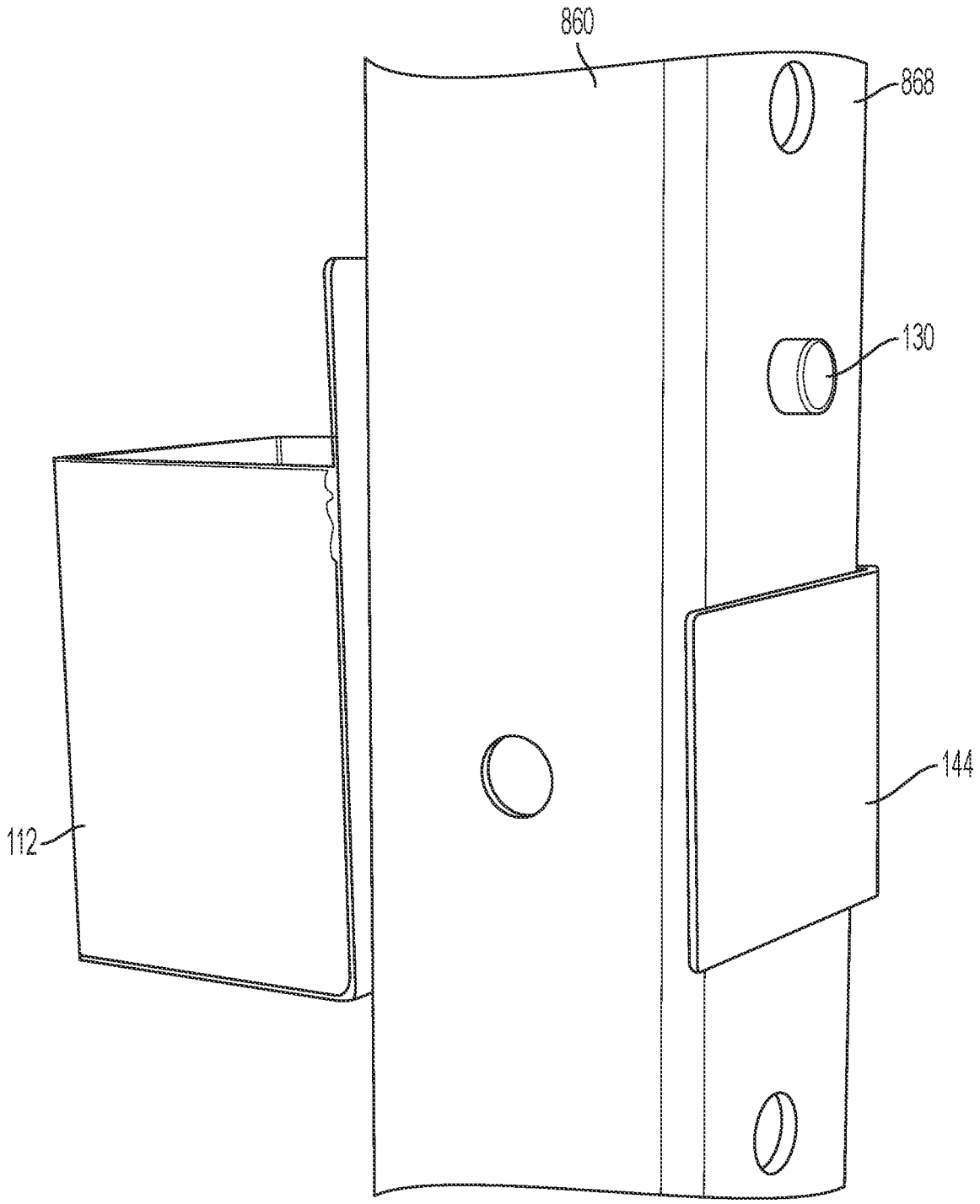
FIG. 11 shows a view of the back-right side of the rackable receptable coupled to the rack support.

FIG. 11 shows a view of the back-right side of the rackable receptable 100 coupled to the rack support 860. As shown, the pin 130 extends through a second hole on the face 868 of the rack support 860. The hole on the face 864 and the hole on the face 868 are aligned.

Alternatively, the pin 130 may be the same length or shorter than the distance between the faces 864 and 868, and thus may not extend fully past the face 868.

Figure 12:
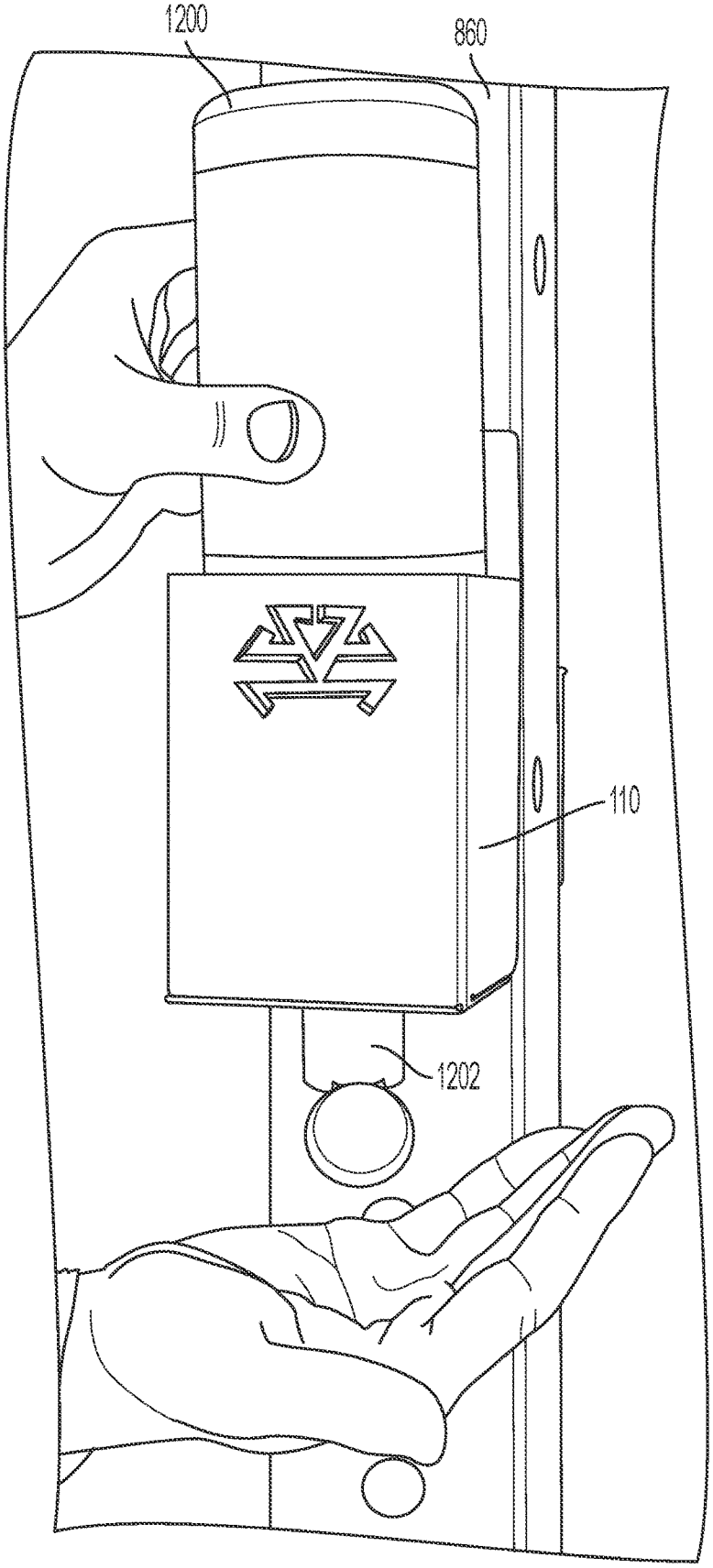
FIG. 12 shows a container of a liquid inserted into the rackable receptacle.
Figure 13:
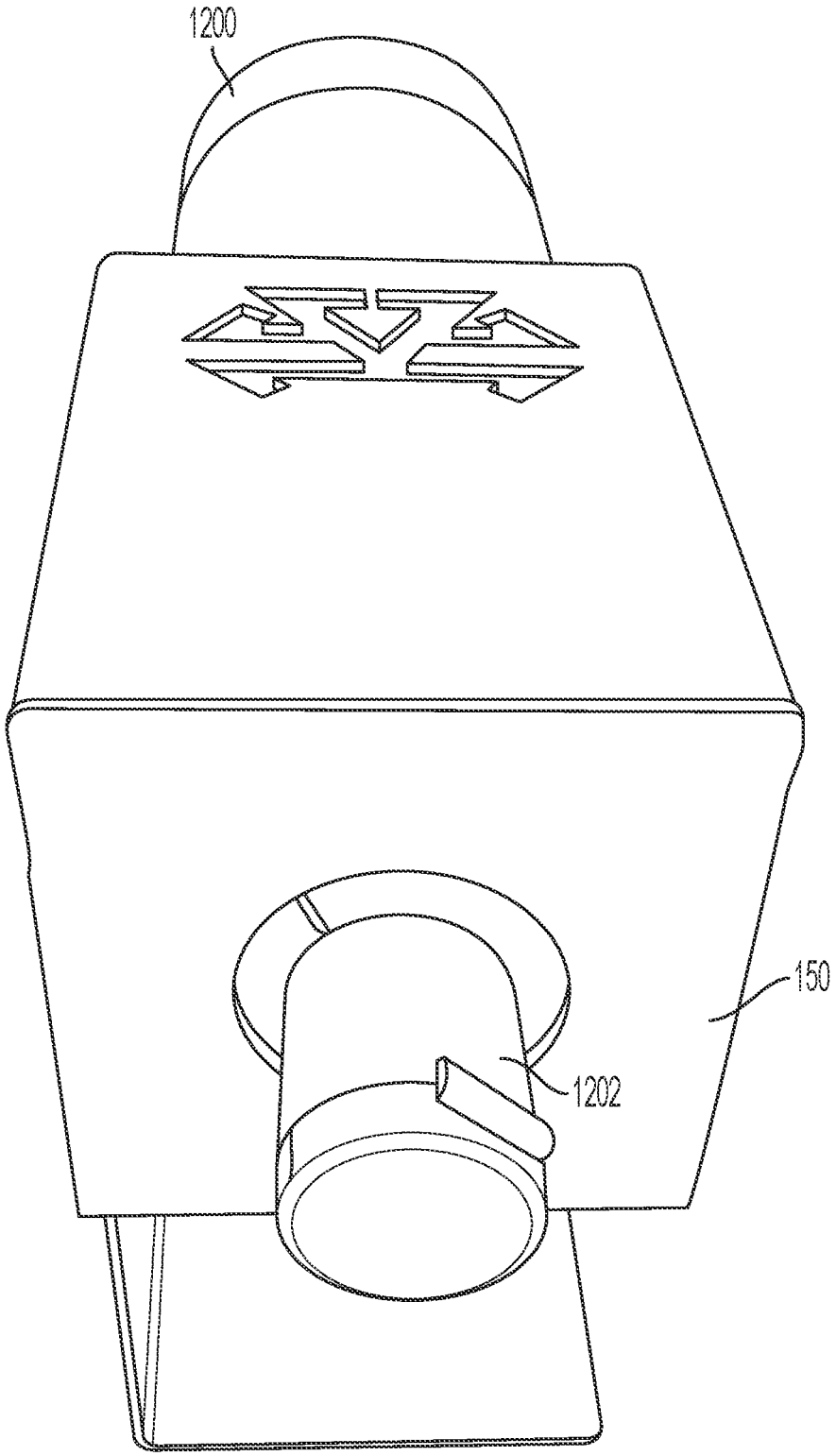
FIG. 13 shows a bottom view of the container of the liquid inserted into the rackable receptacle.

FIG. 12 shows a container of a liquid inserted into the racked rackable receptacle 100. FIG. 13 shows a bottom view of the container of the liquid inserted into the rackable receptacle 100. The container fits in the interior space defined by the wrap 110 and the rear wall 120. The wrap 110 holds the container in an upright position, with a dispensing aperture 1202 extending through the aperture 152 defined in the bottom wall 150.

The container has a body 1200 and a dispensing aperture 1202. The container holds a liquid, e.g., liquid chalk, hand sanitizer, or cleaning solution, and can dispense the liquid through the dispensing aperture 1202. The container body 1200 may be made of a flexible material so that when the dispensing aperture is open, squeezing the body 1200 will dispense the liquid. The dispensing aperture 1202 may be a tapered tube or nozzle. The container body 1200 may extend above the height of the wrap so that an operable portion of the body is accessible to dispense liquid. As described above, the operable portion may be a squeezable portion.

Figure 15:
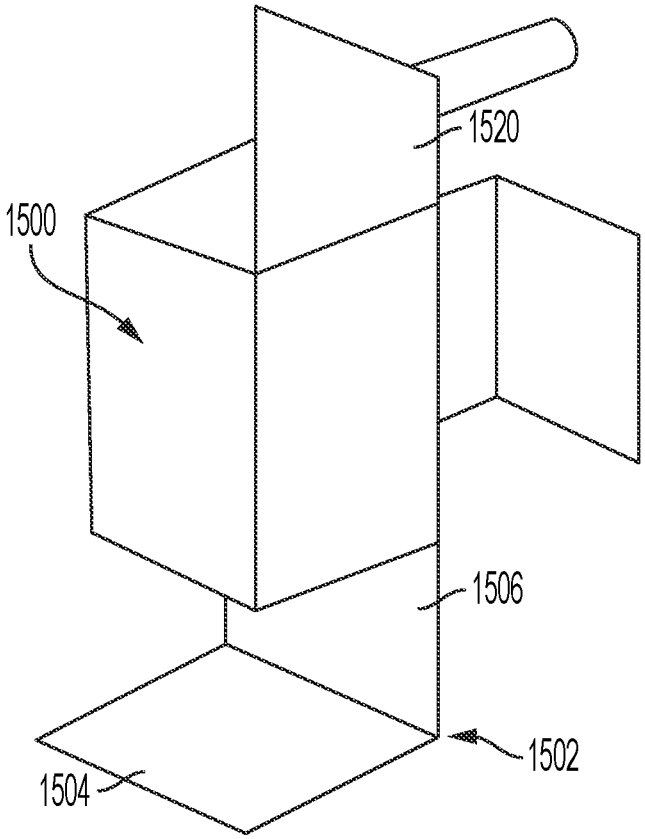
FIG. 15 shows an alternative embodiment of a rack support like the embodiments of FIGS. 1-4 but in this case with a drip catcher.

Alternatively, a container of liquid may have an operable portion such as, for example, a dispensing button that releases a pressurized liquid when pressed, a rotatable handle that dispenses a limited amount of liquid when turned, a motion-sensor that dispenses liquid when an object is sensed beneath the dispensing aperture, or a pump that dispenses a limited amount of liquid when pressed. Such a container may be placed in the interior space of the wrap without extending through the aperture 152, with the operable portion above the wrap, or on a side of the container. For a side-mounted operable portion, instead of there being the aperture 152 in the bottom wall, or in addition to the aperture 152, the wrap may have an aperture defined on its wall to allow the pump to extend therethrough, or the operable portion may be positioned above the wrap. The dispensing aperture 1202 may include a valve or a cap to prevent liquid from leaking out or being dispensed until the operable portion is operated on. In some embodiments, an additional arm may extend forward below the dispensing aperture 1202. The arm may include a shelf or bowl-like structure to catch drips from the dispensing aperture 1202. For example, FIG. 15 shows a rackable receptacle 1500 that is generally like other embodiments disclosed herein but which includes a drip catcher 1502 suitably spaced below an aperture like seen in other embodiments (but not shown in FIG. 15). The drip catcher in this example has shelf portion 1504 for catching drips and an extension portion 1506 that vertically extends from the main portion of the rackable receptacle and spaces the drip catcher below the aperture of the receptacle at sufficient spacing to allow for one or two hands to access a dispensing end of a container of liquid that is disposed in the receptacle. The two portions of the drip catcher may be a unitary structure that is formed of the same material as the main portion of the receptacle. In this example the shelf portion and the extension portion are formed from the same piece of sheet metal that forms the rear wall 1520 of the rackable receptacle, with the shelf portion being a 90-degree bend at the end of the extension portion.

Figure 14:
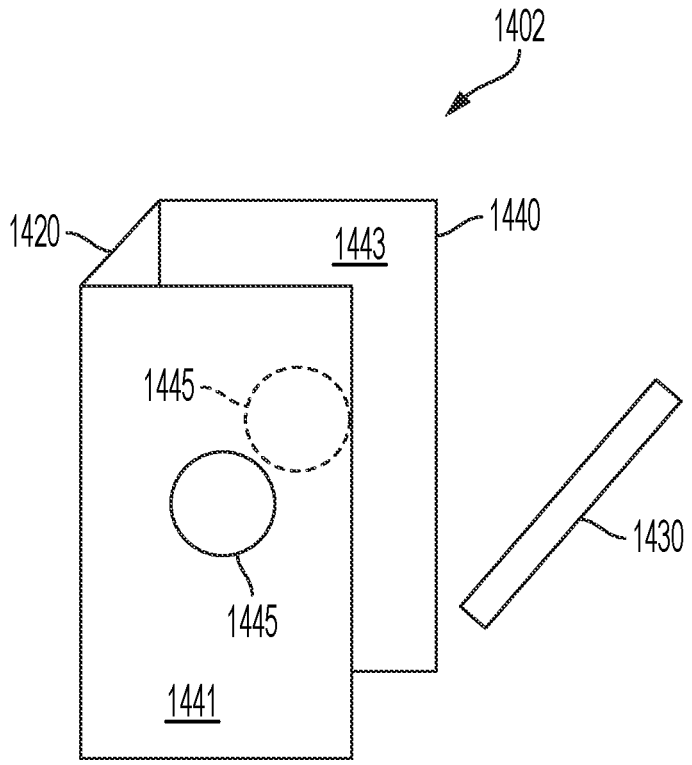
FIG. 14 shows a second embodiment of a rack support component for a rackable receptacle.

FIG. 14 shows another embodiment of a racking body 1402 for a rackable receptacle. The racking body 1402 can have a stabilizer 1440 that has a first side panel 1441 extending orthogonally rearward from the rear wall 1420 and a second side panel 1443 extending orthogonally rearward from the rear wall 1420 parallel to the first side panel 1441. Each respective side panel can define an aperture 1445 that is axially aligned with the aperture defined on the respective other side panel.

The first and second side panels can be spaced apart at a width configured to allow a rack support to be inserted between the side panels. When the apertures 1445 are aligned with the holes, e.g., hole 862, on a rack support 860, a pin 1430 (or a bolt) can be inserted through the apertures and holes to hold the racking body 1402 in place on the rack support. The rackable receptacle can also include a bottom wall and a wrap (not shown) as described above.

The examples described above generally various principles related to receptacles that can be attached to a weight training rack or similar structure, for holding a dispensing container of liquid. The previous description is provided to enable a person skilled in the art to make or use the disclosed principles. Embodiments other than those described above in detail are contemplated based on the principles disclosed herein, together with any attendant changes in configurations of the respective apparatus or changes in order of method acts described herein, without departing from the spirit or scope of this disclosure. Various modifications to the examples described herein will be readily apparent to those skilled in the art.

As used herein, "and/or" means "and" or "or", as well as "and" and "or." Moreover, any patent and non-patent literature cited herein is hereby incorporated by reference in its entirety for all purposes.

And, those of ordinary skill in the art will appreciate that the exemplary embodiments disclosed herein can be adapted to various configurations and/or uses without departing from the disclosed principles. Applying the principles disclosed herein, it is possible to provide a wide variety of rackable receptacle products, and methods of use. For example, the principles described above in connection with any particular example can be combined with the principles described in connection with another example described herein. Thus, all structural and functional equivalents to the features and method acts of the various embodiments described throughout the disclosure that are known or later come to be known to those of ordinary skill in the art are intended to be encompassed by the principles described and the features and acts claimed herein. Accordingly, neither the claims nor this detailed description shall be construed in a limiting sense, and following a review of this disclosure, those of ordinary skill in the art will appreciate the wide variety of rackable receptacle for liquid containers, and methods of use that can be devised under disclosed and claimed concepts.

Moreover, nothing disclosed herein is intended to be dedicated to the public regardless of whether such disclosure is explicitly recited in the claims. To aid the Patent Office and any readers of any patent issued on this application in interpreting the claims appended hereto or otherwise presented throughout prosecution of this or any continuing patent application, applicants wish to note that they do not intend any claimed feature to be construed under or otherwise to invoke the provisions of 35 USC 112(f), unless the phrase "means for" or "step for" is explicitly used in the particular claim.

The appended claims are not intended to be limited to the embodiments shown herein, but are to be accorded the full scope consistent with the language of the claims, wherein reference to a feature in the singular, such as by use of the article "a" or "an" is not intended to mean "one and only one" unless specifically so stated, but rather "one or more".

Thus, in view of the many possible embodiments to which the disclosed principles can be applied, we reserve the right to claim any and all combinations of features and acts described herein, including the right to claim all that comes within the scope and spirit of the foregoing description, as well as the combinations recited, literally and equivalently, in any claims presented anytime throughout prosecution of this application or any application claiming benefit of or priority from this application, and more particularly but not exclusively in the claims appended hereto.

The invention claimed is:

1. A rackable receptacle comprising:

a racking body having a rear wall having a front face and a rear face, a bottom wall extending orthogonally in a front direction from the front face, and means for detachably coupling the racking body to a rack support, wherein the bottom wall defines an aperture configured to permit dispensing a liquid therethrough;

a wrap coupled to the racking body comprising a wall extending orthogonally upward from the bottom wall wherein the wall defines an interior compartment;

wherein the means for detachably coupling the racking body to the rack support comprises a stabilizer having a side panel extending orthogonally rearward from the rear wall and a rear panel coupled to the side panel and extending parallel to the rear wall; and a pin extending orthogonally rearward from the rear face.

2. The rackable receptacle of claim 1, further comprising a container comprising a body and a dispensing aperture, the container configured to hold a liquid and to dispense a liquid through the dispensing aperture, wherein the rackable receptacle is configured to hold the container in the interior compartment with the dispenser aperture extending through the aperture defined in the bottom wall.

3. The rackable receptacle of claim 1, wherein the wall of the wrap comprises a right wall, a front wall, and a left wall, wherein the left wall and the right wall are each, respectively, coupled on one side to the rear wall and on an opposing side to the front wall, and are coupled to the bottom wall.

4. The rackable receptacle of claim 3, wherein the front wall is parallel to the rear wall.

5. The rackable receptacle of claim 1 wherein the racking body comprises a unitary structure of bent sheet metal.

6. The rackable receptacle of claim 1 further comprising a drip catcher disposed below the aperture.

7. The rackable receptacle of claim 5 further comprising a drip catcher disposed below the aperture.

8. The rackable receptacle of claim 7 wherein the drip catcher is also part of the unitary structure of sheet metal.

9. A rackable receptacle comprising:

a racking body having a rear wall having a front face and a rear face, a bottom wall extending orthogonally in a front direction from the front face, and means for detachably coupling the racking body to a rack support, wherein the bottom wall defines an aperture configured to permit dispensing a liquid therethrough;

a wrap coupled to the racking body comprising a wall extending orthogonally upward from the bottom wall wherein the wall defines an interior compartment;

wherein the means for detachably coupling the racking body to the rack support comprises a stabilizer having a first side panel extending orthogonally rearward from the rear wall on a left side and a second side panel extending orthogonally rearward from the rear wall parallel to the first side panel, wherein each side panel defines an aperture that is axially aligned with the aperture defined on the respective other side panel;

wherein the first and second side panels are spaced apart at a width configured to allow a rack support to be inserted between the side panels, the rack support having a pair of parallel spaced apart holes; and a pin configured to be inserted through the apertures defined in the side panels and through the holes in the rack support.

10. A rackable receptacle dispenser system comprising:

a racking body having a rear wall having a front face and a rear face, a bottom wall extending orthogonally in a front direction from the front face, and means for detachably coupling the racking body to a rack support;

a wrap coupled to the racking body comprising a wall extending orthogonally upward from the bottom wall, wherein the wall defines an interior compartment;

a container comprising a body and a dispensing aperture, the container configured to hold a liquid and to dispense a liquid through the dispensing aperture, and wherein the container body comprises an operable portion, wherein the operable portion extends above the wrap and is configured to dispense the liquid when operated;

wherein the system is configured to hold the container in the interior compartment; and wherein an operable portion comprises a squeezable portion, a pump, a rotatable handle, a motion sensing dispenser, or a dispensing button.

11. The rackable receptacle dispenser system of claim 10, further comprising a liquid contained in the container, the liquid comprising liquid chalk.

12. The rackable receptacle dispenser system of claim 10, wherein the bottom wall defines an aperture, and wherein the dispensing aperture extends through the aperture defined in the bottom wall.

13. The rackable receptacle dispenser system of claim 10, wherein the wrap defines an aperture, and wherein the dispensing aperture extends through the aperture defined in the wrap.

14. The rackable receptacle dispenser system of claim 10, wherein the wrap is configured to hold the container in an upright position.

15. The rackable receptacle dispenser system of claim 10, further comprising a liquid contained in the container, the liquid comprising a hand sanitizer or hand cleaning liquid.

* * * * *